United States Patent [19]

Nishio et al.

[11] Patent Number: 4,761,264

[45] Date of Patent: Aug. 2, 1988

[54] METHOD FOR MOLDING POWDERS

[75] Inventors: Hiroaki Nishio; Jun Harada, both of Tokyo, Japan

[73] Assignee: Nippon Kokan Kabushiki Kaisha, Tokyo, Japan

[21] Appl. No.: 61,896

[22] Filed: Jun. 12, 1987

[30] Foreign Application Priority Data

Jun. 17, 1986 [JP] Japan ..... 61-139158

[51] Int. Cl.[4] ..... B22F 1/00

[52] U.S. Cl. ..... 419/68; 249/65; 249/112; 249/127; 264/102; 264/220; 264/571; 264/DIG. 78; 419/60; 419/66; 425/405.1; 425/405.2; 425/DIG. 14

[58] Field of Search ..... 419/66, 68, 60; 264/102, 571, DIG. 78, 220; 249/65, 112, 127; 425/405 R, 405 H, DIG. 14

[56] References Cited

U.S. PATENT DOCUMENTS

| | | | |
|---|---|---|---|
| 1,883,854 | 11/1929 | Jeffery | 419/65 |
| 3,551,946 | 1/1971 | Backer et al. | 419/68 |
| 3,577,635 | 5/1971 | Bergman et al. | 419/68 |
| 3,862,286 | 1/1975 | Couchman | 419/68 |
| 4,582,682 | 4/1986 | Betz et al. | 419/68 |
| 4,612,163 | 9/1986 | Nishio et al. | 419/68 |

FOREIGN PATENT DOCUMENTS

| | | |
|---|---|---|
| 0133515 | 2/1985 | European Pat. Off. . |
| 60-56499 | 4/1985 | Japan . |
| 61-64801 | 4/1986 | Japan . |
| 787352 | 12/1957 | United Kingdom . |

*Primary Examiner*—Stephen J. Lechert, Jr.
*Attorney, Agent, or Firm*—Frishauf, Holtz, Goodman & Woodward

[57] ABSTRACT

A method for molding powders which comprises introducing a thin-wall resilient mold inside a ventilative mold support, reducing the outside pressure of the ventilative mold support to less than the atmospheric pressure (760 Torr), putting a thin-wall resilient mold exactly close to the inside wall of the ventilative mold support, supplying powder material into the thin-wall resilient mold, exhausting air existing in the voids formed in the powder material, and taking the ventilative mold support apart to apply cold isostatic press treatment to the thin-wall resilient mold. The shape of the thin-wall resilient mold is similar to the shape of the ventilative mold support.

21 Claims, 2 Drawing Sheets

METHOD FOR MOLDING POWDERS

BACKGROUND OF THE INVENTION

The present invention relates to a method for molding powders, and more particularly to a method for operating a cold isostatic press.

DESCRIPTION OF THE PRIOR ART

A cold isostatic press (hereinafter abbreviated as C.I.P.) method is well known for carrying out a method wherein metallic or ceramic powders are charged into a resilient mold, the mold is sealed, and pressure is applied at the normal temperature, to produce a homogeneous green compact. In order to obtain a compact of a desired shape, however, it is required to use a resilient mold which has thickness and strength sufficient so as not to deform due to the weight of the powders. In this case, the resilient mold is, during the operation of the C.I.P., so hard to deform, and, the cover and the corners of the resilient mold are, in particular, so hard to deform that the dimensional accuracy of the shape-forming becomes low. Consequently, this method is disadvantageous in that considerable machining on the green compact is required for shape modification after the C.I.P. process is finished.

To overcome these difficulties, various methods have been reported. For example, Japanese Patent Applications, Examined Publication No. 56499/85 and Laid open No. 183780/84 disclose a method wherein:

(a) a ventilative mold of porous material is used for outer-supporting;

(b) a thin resilient cover is installed along the inside wall of the ventilative mold, the outside pressure of the ventilative mold being reduced;

(c) powder materials for the molding are charged into the thin resilient pouch and followed by the process wherein the outside pressure of the resilient mold is increased and, in addition, the inside pressure of the thin resilient pouch is reduced; and (d) the ventilative mold for outer supporting is removed, and, then, the thin resilient pouch is applied to a C.I.P. too.

In this method, however, a simple thin resilient pouch or sack is used. Since the shape of the pouch or sack is different from that of the ventilative mold for outer supporting, the expansion of the thin resilient pouch is different, in places, when the pouch is put close to the ventilative mold by making use of the balance between the outside pressure of the mold and the inside pressure of the pouch. The contraction of the pouch is differently produced, when the C.I.P. treatment is applied. As a result, the edge parts of a green compact, particularly required to be accurate in dimension, is forced to become round. The accuracy in dimension remains still unsolved using this method.

SUMMARY OF THE INVENTION

It is an object of the present invention to provide a method for molding powders good in accuracy in dimension.

In accordance with the present invention, a method is provided for molding powders which comprises the steps of:

introducing a thin-wall resilient mold similar to an inside shape of a ventilative mold support and to a shape of a green compact, into the inside of the ventilative mold support;

reducing pressure outside the ventilative mold support, by operation of a vacuum pump, to less than the atmospheric pressure (760 Torr), to put the thin resilient mold close to the inside wall of the ventilative mold support;

supplying powder material into the thin-wall resilient mold;

exhausting air existing in the voids which the powder material forms; and sealing the thin-resilient mold; and taking out the thin-wall resilient mold filled with the material powders by taking the ventilative mold support apart to apply a C.I.P. treatment to the thin-wall resilient mold.

Other objects and advantages of the present invention will become more apparent from the detailed description to follow taken in conjunction with the appended drawings.

DESCRIPTION OF THE PREFERRED EMBODIMENT

Referring now specifically to the drawings, an embodiment of the present invention will be described in detail. FIGS. 1 to 6 schematically illustrate respective steps in sequence according to the present invention.

Figure 1:
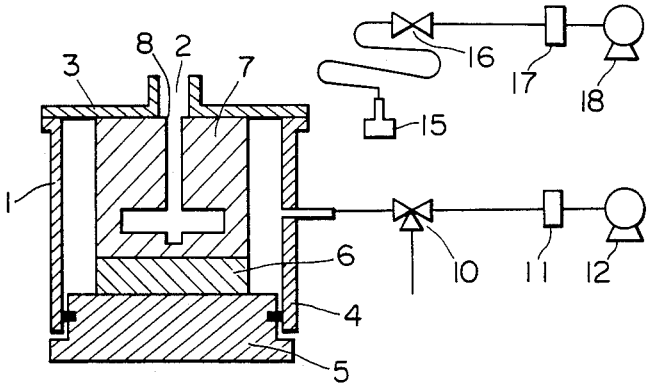
FIGS. 1 to 6 are schematic views illustrating sequentially and specifically respective steps according to the present invention.
Figure 2:
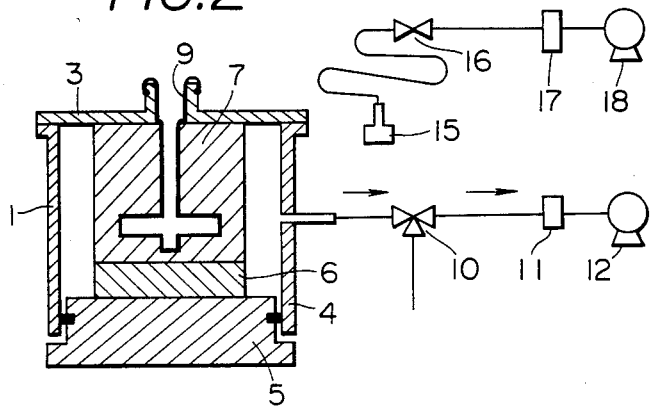

Turning to FIG. 1, vacuum vessel 1 comprises an upper cover 3 equipped with gate 2, outer cylinder 4 and lifting table 5. Ventilative mold support 7 is installed on sample support 6 which is mounted on the lifting table 5. Ventilative mold support 7 has an opening 8 on its top. Opening 8 and gate 2 have a concentric center. The top surface of ventilative mold 7 and upper cover 3 are put close together. With reference specifically to FIG. 2, the opening of thin-wall resilient mold 9 is fixed to gate 2 and the thin-wall resilient mold is introduced into the inside of ventilative mold support 7. The thin-wall resilient mold 9 is similar in shape to the inside shape of the ventilative mold support 7, i.e., to a shape of a green compact. The pressure outside the ventilative mold support 7 is reduced to less than the atmospheric pressure (760 Torr), by means of vacuum pump 12, through a lead-in pipe set in the ventilative mold support, the lead-in pipe being provided with dust filter 11, so as to cause thin-wall resilient mold 9 to be put completely close to the whole inside shape of ventilative mold support 7. In this process, it is required that the thin-wall resilient mold 9 be put exactly close to the inside wall of the ventilative mold support as if the shape of the thin-wall resilient mold were equal to that of the ventilative mold support.

The pressure outside the ventilative mold support 7 is set preferably to 400 Torr or less. If the pressure outside is over 400 Torr, the thin-wall resilient mold fails to be put close enough to the inside wall of the ventilative mold. If the pressure outside is reduced to approximately 10 Torr, almost any kind of thin-wall resilient rubber molds 9 can be put close to the inside wall of the ventilative mold.

Figure 3:
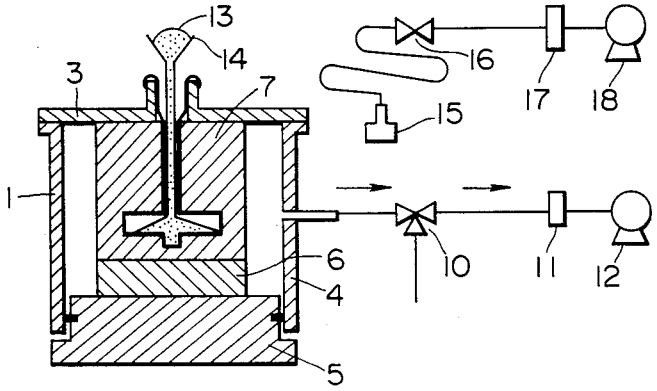

As shown in FIG. 3, when the shape of the resilient thin-wall mold 9 is completely formed, powder material 13 is supplied through feeder 14 into the thin-wall resilient mold. In order to fill up the powder material homogeneously and in high packing density within the thin-wall resilient mold, a vibrator can be used, and, or alternatively, the end level of feeder 14 can be vertically moved depending on the condition of the fill-up.

Figure 4:
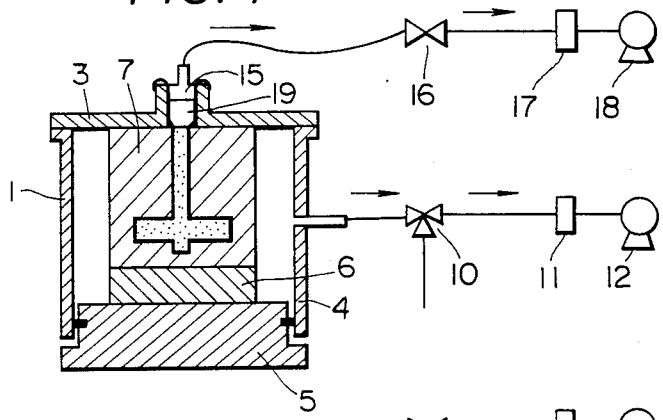

With reference to FIG. 4, when the fill-up of powder material 13 is finished, empty space 19 is formed above the top level of the powder material within gate 2, wherein dust filter 15 is set, to exhaust air existing in the voids, which the material powders form, by means of vacuum pump 18 connected with dust filter 15 through a lead-in pipe provided with valve 16 and dust filter 17. The pressure inside thin-wall resilient mold 9 is set preferably to 100 Torr or less, and more preferably to 10 Torr or less. If the pressure inside is over 100 Torr, the difference between the pressure inside and the atmospheric pressure becomes too small to keep the shape of pre-mold body 21, which will be described later. If the pressure inside is 10 Torr or less, the shape is improved. It is also preferable to keep pump 12 in operation during the exhaust of the air existing in the voids, in order that the pressure outside ventilative mold support 7 may be maintained lower than the pressure inside thin-wall resilient mold 9.

Figure 5:
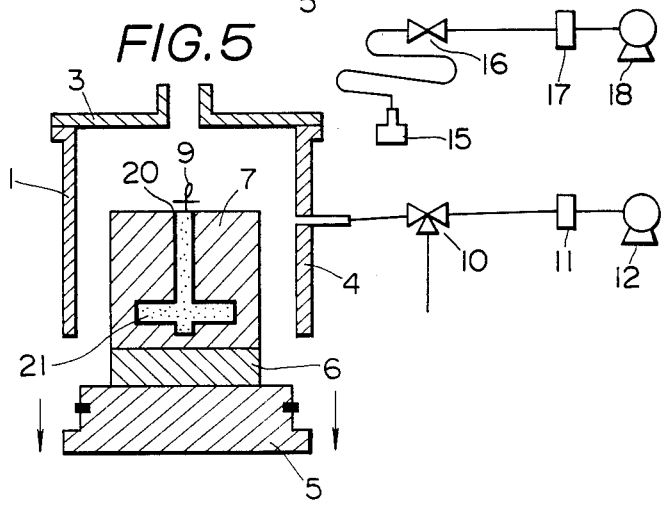

With particular reference to FIG. 5, when the pressure inside the thin-wall resilient mold reaches a predetermined pressure, the exhausting operation of pump 12 is stopped and the pressure outside ventilative mold support 7 is brought, through change of air-flow by means of three-way changeable cock 10, to the atmospheric pressure. At this stage, the part of the shape of the thin-wall resilient mold surrounded by empty space 19 is collapsed and the collapsed part of the mold is nippled by clamp 20 to be sealed.

As shown in FIG. 5, vacuum vessel 1 is then taken away. Next, ventilative mold support 7 is taken apart, to take out pre-mold body 21. Since the inside of the pre-molded body is less than atmospheric pressure (760 Torr), the pre-molded body is always receiving the isostatic pressure corresponding to the difference between the pressure outside the ventilative mold support 7 and the pressure inside thin-wall resilient mold 9. Resultantly, the pre-molded body, i.e., the shape of the thin-wall resilient mold can continue, without the ventilative mold support, to be the shape as it is.

Figure 6:
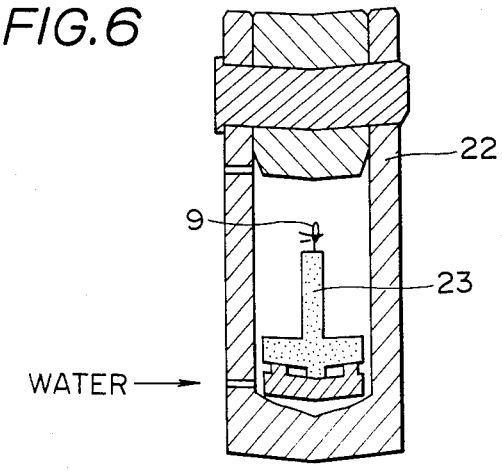

Lastly, as shown in FIG. 6, pre-molded body 21 is housed in a C.I.P apparatus 22. Water is introduced into the C.I.P. apparatus to increase pressure therein and to keep the increased pressure for several minutes. This allows the pre-molded body to contract and increase in density to turn into a green compact 23. The pressure is desired to be increased to 2000 to 4000 atm. when ceramic powders are used as powder material. Even if the pressure is increased to more than 4000 atm., the fill-up density is unchangeable since ceramic powders do not deform plastically. Alternately, if the the pressure is 2000 atm. or less, the fill-up density is not satisfactory. When metallic powders are used as material powders, 2000 to 6000 atm. of pressure is preferable. Even if the pressure is increased over 6000 atm., the effect in increasing the fill-up density is considered to be small, although metallic powders deform plastically. If the pressure is less than 2000 atm., the fill-up density is not satisfactory.

A green compact, thus molded, can be easily taken out by means of taking clamp 20 off and removing thin-wall resilient mold 9.

Material for ventilative mold support 7 can be any one selected from the group consisting of plastics, metal, ceramics, and composite material of ceramics and metal. As the plastic, polyamide resin, polycarbonate resin, ABS resin or AS resin can be used. As the metal, copper alloy, stainless steel or alminium can be used. As the ceramics, almina and silica can be used. Ventilation performance of the ventilative mold support can be improved by providing vent-holes in the aforementioned materials. The ventilative mold support can be made of porous materials. The porous materials are made by mixing porous materials or use of foaming agents. As the porous materials, gypsum or molding sand can be used.

The thin-wall resilient mold 9 is high in elasticity, formed of natural or synthetic rubber. As the synthetic rubber, styrene-butadiene rubber, polyisoprane rubber or isobutylane-isoprane rubber is preferable. It is preferable that the thin-wall resilient mold has a shape similar to an inside shape of the ventilative mold support 7, and is capable of being put exactly close to the inside wall of the ventilative mold support, without expansion. Alternatively, the thin-wall resilient mold can be a mold being capable of being put exactly close to the inside shape the ventilative mold support when the mold is slightly expanded by an equal proportion on the whole shape.

The thickness of the thin-wall resilient mold ranges from 50 to 2000 μm preferably, depending on the size and shape of the mold. The range of 100 to 500 μm is more preferable. If the thickness is less than 50 μm, it happens to cause pin holes on the mold or to break the mold. If it is 2000 μm or less, the mold is kept exactly close to pre-molded body 21. On the other hand, if it is over 2000 μm, the pre-molded body is sometimes broken, owing to the restoration work of the mold.

The thin-wall resilient mold is manufactured by a method wherein a metallic pattern is first prepared, and dipped in latex to which a coagulant has been added, and then, the dipped metallic pattern taken out, is heated to accelerate hardening of the latex on the surface of the metallic pattern. The heating temperature ranges from 50° to 90° C. preferably. The heating is carried out by putting the metallic mold covered by the latex into a heating furnace or by blowing hot air on the metallic pattern. Instead of the heating, the latex on the surface of the metallic pattern can be hardened by being released in the air.

Materials for a green compact are recommended to be processed so as to have a good fluidity and packing characteristics in particle size and shape. Specifically, for example, when stainless steel, tool steel or superalloy is manufactured, it is appropriate to use spherical powders by means of an argon atomizing method, vacuum spraying method or rotating electrode method. In the case of titanium or titanium alloy, it is desirable to use spherical powders using a plasma rotating electrode method. In the case of carbonyl iron, metallic powders of carbonyl-nickel, dispersion-strengthened metallic powders of super alloy, alumina, zirconia, silicon nitride, silicon carbide or sialon, it is preferable to granulate powders into spherical form.

EXAMPLE 1

Two kinds of samples for green compacts were prepared; steel spherical powders in particle size of 80 to 200 meshes and almina powders in particle size of 20 to 100 μm.

An aluminum pattern was firstly prepared. The pattern was equipped with a shaft of 20 mm in diameter and 60 mm in length, and with a disk plate of 80 mm in diameter and 20 mm in thickness attached to the shaft at a distance from 20 mm of one end of the shaft. Subsequently, the pattern was dipped in latex to which a coagulant had been added. Then, the dipped pattern was taken out and heated at the temperature of 70° C., to form a thin-wall latex mold of approximately 100 μm in thickness, similar to the shape of the pattern. A porous mold support of gypsum having an internal cavity similar in shape to the shape of the pattern was also prepared.

The thin-wall latex mold was put close to the porous gypsum mold support, thereby to form a pre-molded body. To the steel spherical powders, C.I.P. treatment was applied at a pressure of 5000kg/cm$^2$, and to the almina powders at a pressure of 3,000kg/cm$^2$. The roundness of the molded disk plate was measured. In either of the cases of the measurement, the dispersion of the disk diameter was 0.1% or less. The disk diameters actually measured for each, were given as follows:

For steel spherical powders: 70.83±0.08 mm

For alminum powders: 68.10±0.05 mm

EXAMPLE 2

A green compact having a gear shape was manufactured by using atomized stainless steel powders as the powder material.

Firstly, an alminum pattern was prepared having a disk plate of 50 mm in diameter and 10 mm in thickness provided with thirty teeth, and having a shaft of 10 mm in diameter and 50 mm in length in the center of the disk plate.

A thin-wall latex mold was prepared by using the aluminum pattern in the same manner as described in Example 1. Subsequently, an urethane resin mold support having the same cavity shape as the shape of the thin-wall latex mold, was made by using the aluminum pattern.

The thin-wall latex mold was put close to the inside wall of the cavity of the urethane resin mold support by means of suction through vent-holes provided in the urethane resin mold support. Then, the molding was carried out, and, subsequently, C.I.P. treatment was applied at a pressure of 5000 kg/cm$^2$. A green compact increased in density, was obtained. The green compact had a dispersion of nearly to zero, and, the gear teeth of the green compact were finely accurate in dimension and shape, covering the accuracy of the top edge of the teeth.

EXAMPLE 3

A green compact of valve shape was produced by using spherical almina granular powders of 50 to 100 μm in particle size as material powders.

Firstly, an aluminum pattern, having a shaft of 20 mm in diameter and 100 mm in length and a disk plate of 80 mm in diameter and 20 mm at thickness in the shaft end, was prepared. The pattern was dipped in latex to which a coagulant had been added. The dipped pattern was taken out and heated to form a thin-wall latex mold of approximately 100 μm in thickness. Subsequently, a wooden mold support provided with vent-holes was also prepared by using the same pattern.

The pre-molding was carried out by putting the thin-wall latex mold close to the wooden mold support. The C.I.P. treatment was applied at a pressure of 3000 kg/cm$^2$.

A pre-molded body was then contracted isostatically. A green compact with high accuracy in dimension and shape was obtained. Especially, in comparison with a product made by a conventional method employing a thin resilient pouch, there was found no creases in the part connecting the disk plate with the shaft where the dimension is drastically changed.

As described in the above, the method for molding powders according to the present invention enabled molding of a green compact with a complicated shape and with high accuracy in dimension, and particularly with end edge sharpness in shape which had heretofore been considered unobtainable.

What is claimed is:

1. A method of molding powders, comprising:

providing a ventilative mold support having an internal cavity of a predetermined inside shape substantially corresponding to a desired shape of a green compact to be produced;

introducing a thin-wall resilient mold into said cavity of said ventilative mold support, said thin-wall resilient mold having a shape similar to the inside shape of said cavity of said ventilative mold support;

reducing the pressure outside of said ventilative mold support to less than the atmospheric pressure (760 Torr), to pull said thin-wall resilient mold close to the inside wall of said cavity of said ventilative mold support which defines said inside shape;

supplying powder material into the interior of said thin-wall resilient mold;

exhausting air existing in voids which form in the powder material inside said thin-wall resilient mold;

then sealing said thin-wall resilient mold;

taking out said sealed thin-wall resilient mold filled with said powder material by taking apart said ventilative mold support; and then applying a cold isostatic press treatment to said sealed thin-wall resilient mold, to form said powder material inside said thin-wall resilient mold into a green compact.

2. The method of claim 1, wherein said thin-wall resilient mold is made of natural rubber.

3. The method of claim 1, wherein said thin-wall resilient mold is made of synthetic rubber.

4. The method of claim 3, wherein said synthetic rubber is at least one selected from the group consisting of styrene-butadiene rubber, polyisoprene rubber and isobutylene-isoprene rubber.

5. The method of claim 1, wherein said thin-wall resilient mold has a thickness of from 50 to 2000 μm.

6. The method of claim 5, wherein said thickness is from 100 to 500 μm.

7. The method of claim 1, wherein said thin-wall resilient mold is prepared by:

dipping a metallic pattern in latex to form a film over the metallic pattern;

heating the film over the metallic pattern; and removing the film from the metallic pattern.

8. The method of claim 1, wherein said thin-wall resilient mold is prepared by:

dipping a metallic pattern in latex to form a film over the metallic pattern; and releasing the metallic pattern with said latex film thereon to the air; and removing the film from the metallic pattern.

9. The method of claim 1, wherein said ventilative mold support is at least one selected form the group consisting of plastics, wood, metal ceramics, and composite material of ceramic and metal; and is provided with vent-holes.

10. The method of claim 9, wherein said plastics includes at least one selected from the group consisting of polyamide resin, AS resin and urethane resin.

11. The method of claim 9, wherein said metal includes at least one selected from the group consisting of copper alloy, stainless steel and aluminum.

12. The method of claim 9, wherein said ceramics includes at least one selected from the group consisting of alumina and silica.

13. The method of claim 9, wherein said ventilative mold support is made of a porous substance.

14. The method of claim 13, wherein said porous substance comprises gypsum or molding sand.

15. The method of claim 1, wherein said step of exhausting air comprises reducing pressure inside said thin-wall resilient mold to less than the pressure outside said ventilative mold support, the pressure inside said thin-wall resilient mold being 100 Torr or less.

16. The method of claim 15, wherein said pressure inside said thin-wall resilient mold is 10 Torr or less.

17. The method of claim 1, wherein said step of sealing said thin-wall resilient mold comprises:

increasing the pressure outside of said ventilative mold support to the atmospheric pressure (760 Torr); and sealing off an empty space formed in an upper part of said thin wall resilient mold.

18. The method of claim 1, wherein said step of applying said cold isostatic press treatment includes increasing an isostatic pressure to from 2000 to 4000 atm. for the cold isostatic press treatment, when said powder material is a ceramic powder.

19. The method of claim 1, wherein said step of applying said cold isostatic press treatment includes increasing an isostatic pressure to from 2000 to 6000 atm. for the cold isostatic press treatment, when powder material is a metallic powder.

20. The method of claim 1, wherein said powder material includes spherical powder particles treated in a granular form.

21. The method of claim 1, wherein said step of reducing the pressure outside of said ventilative mold support is carried out by operation of a vacuum pump.

* * * * *

UNITED STATES PATENT AND TRADEMARK OFFICE

CERTIFICATE OF CORRECTION

PATENT NO. : 4,761,264

DATED : August 2, 1988

INVENTOR(S) : NISHIO et al

It is certified that error appears in the above-identified patent and that said Letters Patent is hereby corrected as shown below:

Column 1, line 45, "...too" should be -- system --

2, line 14, "material powders" should be --powder material--

3, line 39, "at a pressure" has been omitted following "... body is"

3, line 40, "the" (second occurrence) should be deleted 4, line 25, after "shape" insert -- of --

5, line 49, delete "to"

Signed and Sealed this

Twenty-ninth Day of August, 1989

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,761,264

DATED : August 2, 1988

INVENTOR(S) : Hiroaki NISHIO et al

It is certified that error appears in the above-identified patent and that said Letters Patent is hereby corrected as shown below:

Column 5, line 31, correct the spelling of "aluminum";

, line 60, change "at" to -- in --, and change "in the" to -- at the --.

Signed and Sealed this

Fifteenth Day of May, 1990

*Attest:*

HARRY F. MANBECK, JR.

*Attesting Officer*

*Commissioner of Patents and Trademarks*